US009681498B2

(12) United States Patent
Kobayashi

(10) Patent No.: US 9,681,498 B2
(45) Date of Patent: Jun. 13, 2017

(54) HEATER WITH PARTICLE SHIELD FOR NOISE

(75) Inventor: Akio Kobayashi, Kirishima (JP)

(73) Assignee: Kyocera Corporation, Kyoto (JP)

( * ) Notice: Subject to any disclaimer, the term of this patent is extended or adjusted under 35 U.S.C. 154(b) by 698 days.

(21) Appl. No.: 14/008,856

(22) PCT Filed: Mar. 22, 2012

(86) PCT No.: PCT/JP2012/057280

§ 371 (c)(1),
(2), (4) Date: Sep. 30, 2013

(87) PCT Pub. No.: WO2012/133083

PCT Pub. Date: Oct. 4, 2012

(65) Prior Publication Data

US 2015/0001207 A1 Jan. 1, 2015

(30) Foreign Application Priority Data

Mar. 30, 2011 (JP) ..... 2011-075561

(51) Int. Cl.
*H05B 3/18* (2006.01)
*F23Q 7/00* (2006.01)

(52) U.S. Cl.
CPC ..... *H05B 3/18* (2013.01); *F23Q 7/001* (2013.01); *H05B 2203/027* (2013.01)

(58) Field of Classification Search
CPC ..... F23Q 7/001; H05B 3/18
USPC ..... 219/544, 548, 260, 270
See application file for complete search history.

(56) References Cited

U.S. PATENT DOCUMENTS 3,732,459 A * 5/1973 Oguro ..... H01J 23/15 315/39.51
3,758,750 A * 9/1973 Van Toorn ..... B21F 15/10 219/467.1
3,851,637 A * 12/1974 Green ..... H01T 13/18 123/145 A (Continued)

FOREIGN PATENT DOCUMENTS

JP 07-318055 A 8/1995
JP 10-3355050 A 12/1998

(Continued)

OTHER PUBLICATIONS

Korean Office Action with English concise explanation, Korean Patent Appln. No. 10-2013-7024234, Aug. 29, 2014, 4 pp.

*Primary Examiner* — David Angwin
*Assistant Examiner* — John J Norton
(74) *Attorney, Agent, or Firm* — Volpe and Koenig, P.C.

(57) ABSTRACT

A heater includes a heating element, a pair of lead wires each connected to an end of the heating element, and an insulating base body in which the heating element and the pair of lead wires are embedded. The insulating base body contains a plurality of metal particles around the heating element, the metal particles being separated from the heating element. The plurality of metal particles and the heating element comprise an elliptical cross-section comprising a same major axis direction. With such a structure, when the heater is rapidly cooled to cause a crack on the surface of the insulating base body, the crack develops along the major axis direction of the metal particles and therefore rarely reaches the heating element. This resists breakage of the heating element.

9 Claims, 7 Drawing Sheets

(56) References Cited

U.S. PATENT DOCUMENTS

| | | | | |
|---|---|---|---|---|
| 5,750,958 | A | 5/1998 | Okuda et al. | |
| 2005/0098136 | A1* | 5/2005 | Zhu | F02P 19/028 123/145 A |
| 2014/0042149 | A1* | 2/2014 | Kamitani | H05B 3/16 219/548 |

FOREIGN PATENT DOCUMENTS

| | | | | |
|---|---|---|---|---|
| JP | 2001-052845 | A | | 2/2001 |
| JP | 2001052845 | A | * | 2/2001 |
| JP | 2002-299010 | A | | 10/2002 |
| JP | 2004-273751 | A | | 9/2004 |
| JP | 2004273751 | A | * | 9/2004 |

* cited by examiner

HEATER WITH PARTICLE SHIELD FOR NOISE

TECHNICAL FIELD

The present invention relates to a heater that can be used as an ignition or flame detection heater for combustion-type car heaters, an ignition heater for various combustion apparatuses, such as kerosene fan heaters, a glow plug heater in automotive engines, a heater for various sensors, such as oxygen sensors, or a heater for measuring instruments, for example.

BACKGROUND ART

For example, an ignition heater for various gas or kerosene combustion apparatuses or a heater for various heating apparatuses includes a folded heating element, a pair of lead wires each connected to an end of the heating element, and an insulating base body in which the heating element and the pair of lead wires are embedded (see, for example, Patent Literature 1).

CITATION LIST

Patent Literature

PTL 1: Japanese Unexamined Patent Application Publication No. 2002-299010

SUMMARY OF INVENTION

Technical Problem

Methods of driving an ignition heater for kerosene fan heaters sometimes use pulse control signals from a control circuit in order to control the combustion condition to prevent excessive temperature rise after ignition.

The pulse signals are rectangular and contain high-frequency components at their leading edges. The high-frequency components flow as high-frequency currents on a surface of the heating element. A high-frequency current flow on the heating element, however, generates many radio waves, which adversely affect the control circuit as noise.

In view of the situations described above, it is an object of the present invention to provide a heater in which a high-frequency current flowing through the heating element of the heater in pulse driving negligibly affects the control circuit of the heater.

Solution to Problem

A heater according to the present invention includes a heating element, a pair of lead wires each connected to an end of the heating element, and an insulating base body in which the heating element and the pair of lead wires are embedded, wherein the insulating base body contains a plurality of metal particles around the heating element, the metal particles being separated from the heating element.

Advantageous Effects of Invention

A heater according to the present invention includes a heating element, a pair of lead wires each connected to an end of the heating element, and an insulating base body in which the heating element and the pair of lead wires are embedded. The insulating base body contains a plurality of metal particles around the heating element, the metal particles being separated from the heating element. Thus, even when a high-frequency current flows, the metal particles act as a shield for preventing radio waves from being sent to a control circuit and adversely affecting the control circuit as noise.

BRIEF DESCRIPTION OF DRAWINGS

FIG. 1(*b*) is a transverse sectional view taken along the line A-A in FIG. 1(*a*). FIG. 1(*c*) is a transverse sectional view taken along the line B-B in FIG. 1(*a*).

DESCRIPTION OF EMBODIMENTS

A heater according to an embodiment of the present invention will be described in detail below with reference to the accompanying drawings.

Figure 1:
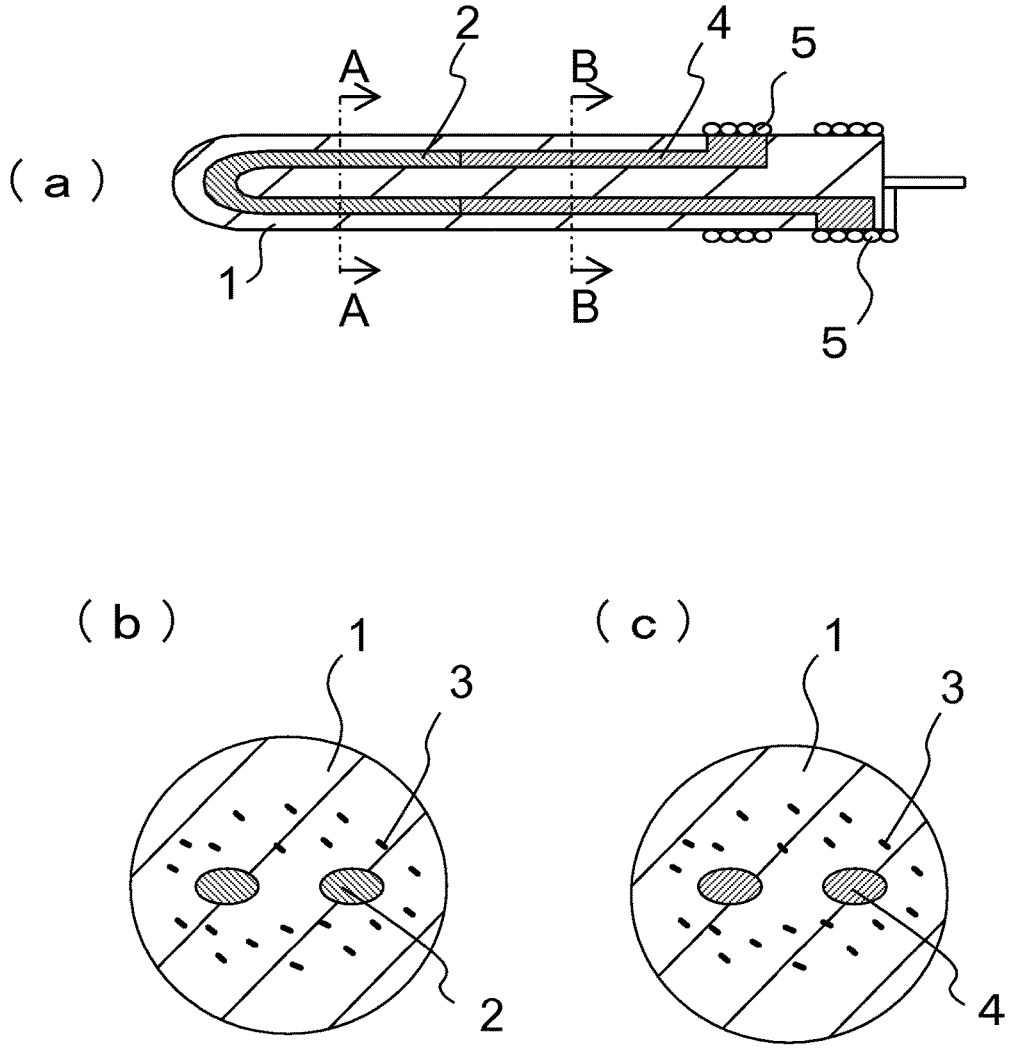
FIG. 1(*a*) is a longitudinal sectional view of a heater according to an embodiment of the present invention.

FIG. 1(*a*) is a longitudinal sectional view of a heater according to an embodiment of the present invention. FIG. 1(*b*) is a transverse sectional view taken along the line A-A in FIG. 1(*a*). FIG. 1(*c*) is a transverse sectional view taken along the line B-B in FIG. 1(*a*).

As illustrated in FIG. 1, a heater according to the present embodiment includes a heating element 2, a pair of lead wires 4 each connected to an end of the heating element 2, and an insulating base body 1 in which the heating element 2 and the pair of lead wires 4 are embedded. The insulating base body 1 contains a plurality of metal particles 3 around the heating element 2, the metal particles being separated from the heating element 2.

The insulating base body 1 in the heater according to the present embodiment may be a rod or sheet. The heating element 2 and the pair of lead wires 4 are embedded in the insulating base body 1. The insulating base body 1 is preferably made of a ceramic material. This can provide a heater that is highly reliable during rapid heating. Examples of the ceramic material include electrically insulating ceramics, such as oxide ceramics, nitride ceramics, and carbide ceramics. More specifically, the ceramic material may be an alumina ceramic, a silicon nitride ceramic, an aluminum nitride ceramic, or a silicon carbide ceramic. In particular, a silicon nitride ceramic is suitable. This is because the main component silicon nitride of silicon nitride ceramics has high strength, toughness, insulating properties, and heat resistance. The insulating base body 1 made of a silicon nitride ceramic can be produced, for example, by mixing the main component silicon nitride with a sintering aid rare-earth oxide, such as $Y_2O_3$, $Yb_2O_3$, or $Er_2O_3$, which constitutes 3% to 12% by mass, $Al_2O_3$, which constitutes 0.5% to 3% by mass, and $SiO_2$, which constitutes 1.5% to 5% by mass of a sintered body, forming the mixture in a predetermined shape, and hot-press firing the formed mixture at a temperature in the range of 1650° C. to 1780° C. The insulating base body 1 may have a length in the range of 20 to 50 mm and a diameter in the range of 3 to 5 mm.

For the insulating base body 1 made of a silicon nitride ceramic, $MoSi_2$ or $WSi_2$ is preferably dispersed in the silicon nitride ceramic. This can make the thermal expansion coefficient of the silicon nitride ceramic base material close to the thermal expansion coefficient of the heating element 2 and thereby improve the durability of the heater.

The heating element 2 embedded in the insulating base body 1 illustrated in FIG. 1 has a folded shape in the longitudinal section. Approximately the center of the folded shape (near the intermediate point of the folded portion) is a portion of maximum heat generation. The heating element 2 is embedded in the front of the insulating base body 1. The length from the tip (near the center of the folded portion) to the rear end of the heating element 2 may be in the range of 2 to 10 mm. The cross section of the heating element 2 may be circular, elliptical, or rectangular.

The heating element 2 may be made of a material mainly composed of carbide, nitride, or silicide of W, Mo, or Ti. For the insulating base body 1 made of a silicon nitride ceramic, among the materials of the heating element 2 described above, tungsten carbide (WC) is preferred because of a small difference in thermal expansion coefficient from the insulating base body 1, high heat resistance, and low specific resistance. For the insulating base body 1 made of a silicon nitride ceramic, preferably, the heating element 2 is mainly composed of an inorganic electric conductor WC to which 20% by mass or more silicon nitride is added. Since the conductor component of the heating element 2 in the insulating base body 1 made of a silicon nitride ceramic has a higher thermal expansion coefficient than silicon nitride, the heating element 2 is generally under tensile stress. The addition of silicon nitride to the heating element 2 can make the thermal expansion coefficient of the heating element 2 close to the thermal expansion coefficient of the insulating base body 1 and thereby decrease stress caused by a difference in thermal expansion coefficient during heating and cooling of the heater. When the silicon nitride content of the heating element 2 is 40% by mass or less, the resistance of the heating element 2 can be decreased to stabilize the heating element 2. Thus, the silicon nitride content of the heating element 2 is preferably in the range of 20% to 40% by mass, more preferably 25% to 35% by mass. Instead of silicon nitride, 4% to 12% by mass boron nitride may be added to the heating element 2.

One end of each of the lead wires 4 embedded in the insulating base body 1 is connected to the heating element 2, and the other end is exposed on a surface of the insulating base body 1. In FIG. 1, the lead wires 4 are connected to both ends (one end and the other end) of the folded heating element 2. One end of each of the lead wires 4 is connected to one end of the heating element 2, and the other end of each of the lead wires 4 is exposed on a side surface near the rear end of the insulating base body 1.

The lead wires 4 are made of the material of the heating element 2. The lead wires 4 may have a larger cross-sectional area than the heating element 2 or contain a smaller amount of the material of the insulating base body 1 than the heating element 2 to decrease resistance per unit length. In particular, for the insulating base body 1 made of a silicon nitride ceramic, WC is preferred as the material of the lead wires 4 because of a small difference in thermal expansion coefficient from the insulating base body 1, high heat resistance, and low specific resistance. Preferably, the lead wires 4 are mainly composed of an inorganic electric conductor WC and contain silicon nitride, which constitutes 15% by mass or more. As the silicon nitride content increases, the thermal expansion coefficient of the lead wires 4 can approach the thermal expansion coefficient of silicon nitride, which constitutes the insulating base body 1. When the silicon nitride content is 40% by mass or less, the lead wires 4 have low resistance and are stable. Thus, the silicon nitride content is preferably in the range of 15% to 40% by mass, more preferably 20% to 35% by mass.

Each end of the lead wires 4 exposed on a side surface of the insulating base body 1 is electrically connected to a connector 5, which is connected to an external circuit.

As illustrated in FIG. 1(*b*), the insulating base body 1 contains a plurality of metal particles 3 around the heating element 2. The metal particles 3 are separated from the heating element 2. The metal particles 3 are disposed around the entire heating element 2 in the major axis direction of the heating element 2.

For example, the metal particles 3 have an average particle size in the range of 0.1 to 50 μm and are made of W, Mo, Re, Ta, Nb, Cr, V, Ti, Zr, Hf, Fe, Ni, Co, Pd, Pt, or an alloy thereof. The metal particles 3 are preferably made of an electromagnetic wave absorber that absorbs radio waves, such as Fe, Ni, or ferrite. The electromagnetic wave absorber absorbs radio waves and thereby prevents radio waves from being sent to the outside of the heater. The metal particles 3 are preferably distributed in a region 1 μm or more separated from the heating element 2 because this ensures that the metal particles 3 are insulated from the heating element 2 and reduces noise.

Even when a high-frequency current flows through the heating element 2, the metal particles 3 surrounding the heating element 2 act as a shield for preventing radio waves from being sent to a control circuit and adversely affecting the control circuit as noise.

Figure 2:
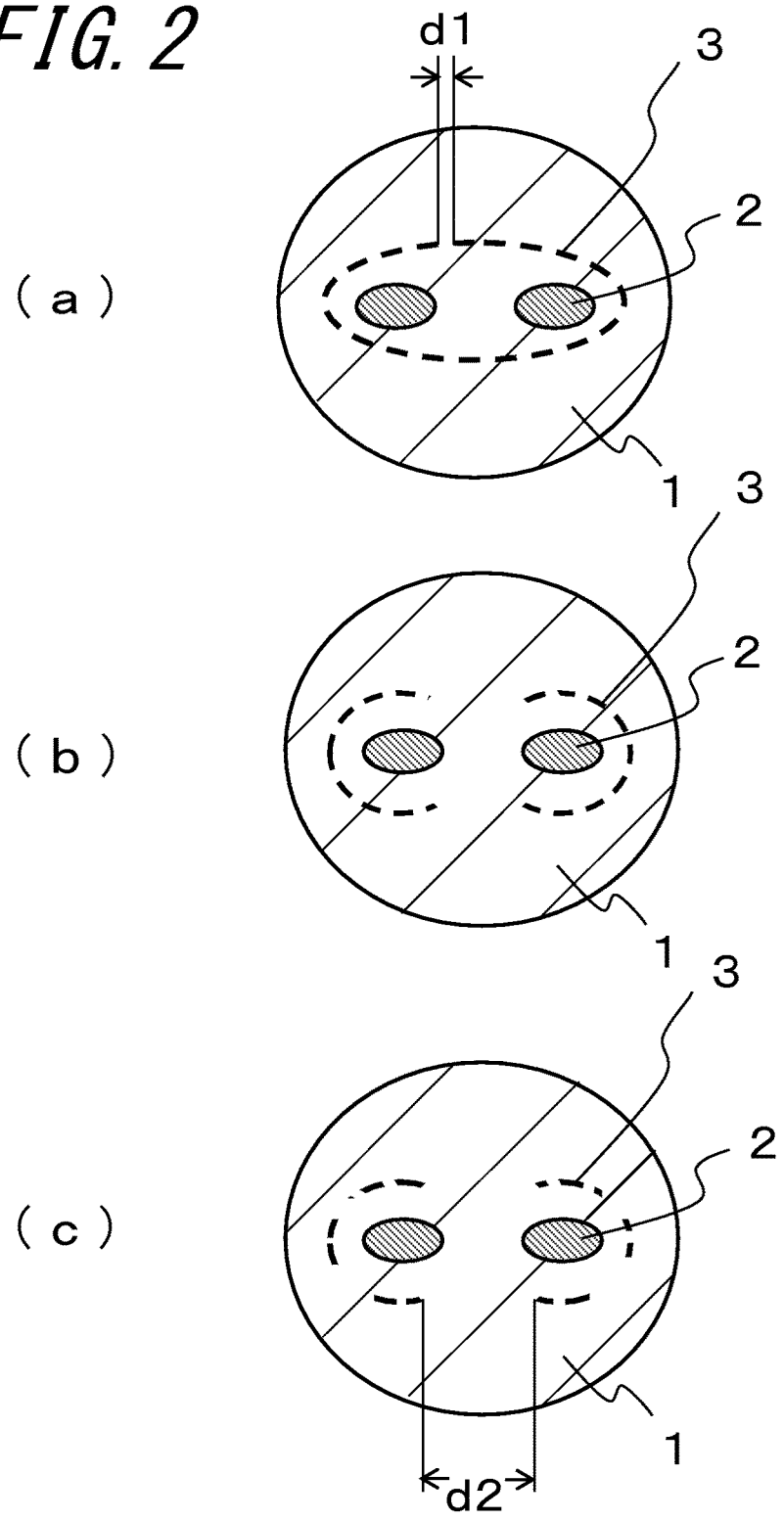
FIGS. 2(*a*) to 2(*c*) are transverse sectional views of a heater according to another embodiment of the present invention taken along the line A-A in FIG. 1.

Although the metal particles 3 are randomly dispersed in FIG. 1(*b*), the metal particles 3 preferably surround the heating element 2 as illustrated in FIG. 2(*a*). The sentence "the metal particles 3 surround the heating element 2" means that as viewed in a cross section as illustrated in FIG. 2(*a*) the metal particles 3 are arranged between the surface of the heating element 2 and the surface of the insulating base body 1 to surround the heating element 2, more specifically, the metal particles 3 are arranged at intervals d1, for example, of 5 μm or less so as to partition the insulating base body 1 between the surface of the heating element 2 and the surface of the insulating base body 1. As illustrated in FIG. 2(*b*) or 2(*c*), as viewed in a cross section, part of the metal particles 3 may be arranged at intervals d2 that are greater than the intervals d1 (for example, in the range of 100 to 500 μm).

The metal particles 3 regularly surrounding the heating element 2 or arranged between the surface of the heating element 2 and the surface of the insulating base body 1 to surround the heating element 2 can prevent radio waves from being sent to the outside of the heating element 2 and further prevent radio waves from adversely affecting a control circuit as noise.

Figure 3:
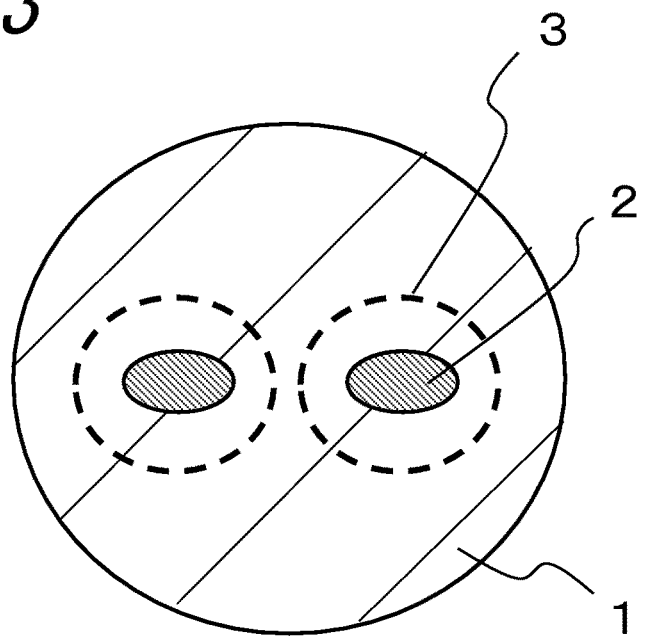
FIG. 3 is a transverse sectional view of a heater according to another embodiment of the present invention taken along the line A-A in FIG. 1.

Furthermore, the metal particles 3 preferably surround the folded heating element 2. In this case, the sentence "the metal particles 3 surround the heating element 2" means that as illustrated in FIG. 3 the metal particles 3 are arranged along the heating element 2 to surround the heating element 2; in other words, the metal particles 3 are arranged along the heating element 2 around the heating element 2 at intervals d1, for example, of 5 μm or less so as to partition the insulating base body 1 not only between the surface of the heating element 2 and the surface of the insulating base body 1 but also between the heating element 2 and the heating element 2.

The metal particles 3 regularly surrounding the heating element 2 or arranged along the heating element 2 to surround the heating element 2 can prevent radio waves from being sent from the heating element 2 in all directions and further prevent radio waves from adversely affecting a control circuit as noise.

When an excessive voltage is applied to the heater to cause a crack in the vicinity of the boundary between the heating element 2 and the insulating base body 1, because of lower strength of the metal particles 3 portion than the insulating base body 1, the crack develops along the distributed metal particles 3 arranged along the heating element 2 to surround the heating element 2 and rarely reaches the outer periphery (the surface of the insulating base body 1). This can prevent the heating element 2 from being exposed to the atmosphere at a high temperature and oxidized. Furthermore, when the heating element 2 is rapidly cooled to cause a crack on the surface of the insulating base body 1, because of lower strength of the metal particles 3 portion than the insulating base body 1, the crack develops along the distributed metal particles 3 arranged along the heating element 2 to surround the heating element 2 and rarely reaches the heating element 2. This can prevent the breakage of the heating element 2.

Figure 4:
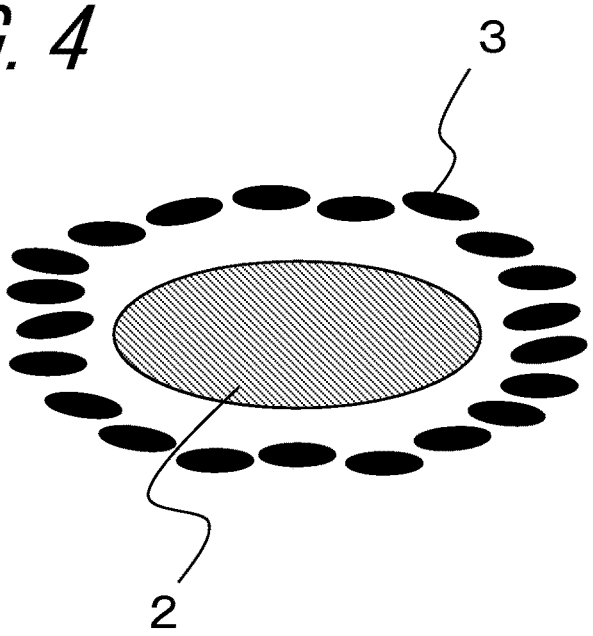
FIG. 4 is an enlarged cross-sectional view of a principal part of a heater according to another embodiment of the present invention taken along the line A-A in FIG. 1.

As illustrated in FIG. 4, the metal particles 3 and the heating element 2 preferably have an elliptical cross-section having the same major axis direction. For example, the average length L1 of the minor axis of the metal particles 3 is in the range of 0.1 to 50 μm, and the ratio (L2/L1) of the length L2 of the major axis to the average length L1 of the minor axis is in the range of 2 to 10. The length L3 of the minor axis of the heating element 2 is in the range of 5 to 200 μm, and the ratio (L4/L3) of the length L4 of the major axis to the length L3 of the minor axis is in the range of 1.5 to 100. When the heater is rapidly cooled to cause a crack on the surface of the insulating base body 1, the crack develops along the major axis direction of the metal particles 3 and rarely reaches the heating element 2. This can prevent the breakage of the heating element 2. Since the heating element 2 is elliptical, the distance (gap) between the metal particles 3 in the minor axis direction of the metal particles 3 can be decreased without markedly increasing the number of metal particles 3 in the minor axis direction relative to the number of metal particles 3 in the major axis direction, thereby allowing a crack to develop along the distributed metal particles 3.

Figure 5:
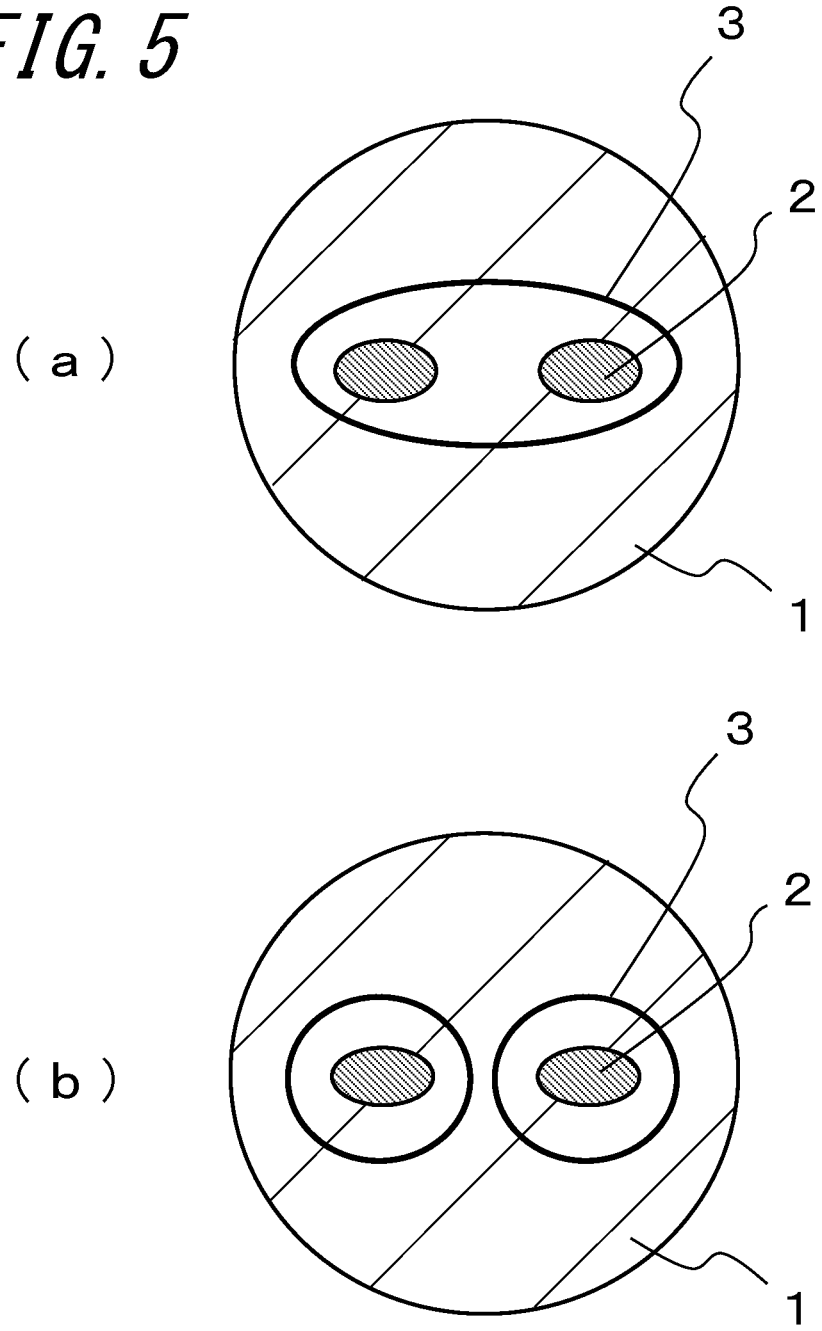
FIGS. 5(*a*) and 5(*b*) are transverse sectional views of a heater according to another embodiment of the present invention taken along the line A-A in FIG. 1.

As illustrated in FIGS. 5(*a*) and 5(*b*), the metal particles 3 are preferably in contact with each other. The phrase "in contact with each other" means that the metal particles 3 in a cross section observed at a magnification of 100 with an electron probe microanalyzer (EPMA) are in contact with each other. The metal particles 3 in contact with each other can closely surround the heating element 2. Thus, even when a high-frequency current flows, radio waves can be prevented from being sent to the outside and can be further prevented from adversely affecting a control circuit as noise.

As illustrated in FIG. 1(*c*), the metal particles 3 are preferably disposed around the pair of lead wires 4. At high temperatures, electron oscillation and movement increase, and radio waves are easily sent out. Thus, more radio waves are sent from the heating element 2. Although being fewer than the radio waves sent from the heating element 2, radio waves are also sent from the lead wires 4. The metal particles 3 disposed around the lead wires 4 can act as a shield for preventing radio waves from being sent from the lead wires 4 to a control circuit and further preventing radio waves from adversely affecting the control circuit as noise.

A method for manufacturing a heater according to the present embodiment will be described below.

First, a ceramic powder, such as an alumina, silicon nitride, aluminum nitride, or silicon carbide ceramic powder, is mixed with a sintering aid, such as $SiO_2$, CaO, MgO, or $ZrO_2$, to prepare a ceramic powder, which is a raw material for the insulating base body 1.

The ceramic powder is pressed to form a compact. Alternatively, a ceramic slurry is prepared from the ceramic powder and is formed into a ceramic green sheet. The compact or the ceramic green sheet corresponds to half of the insulating base body 1.

Figure 6:
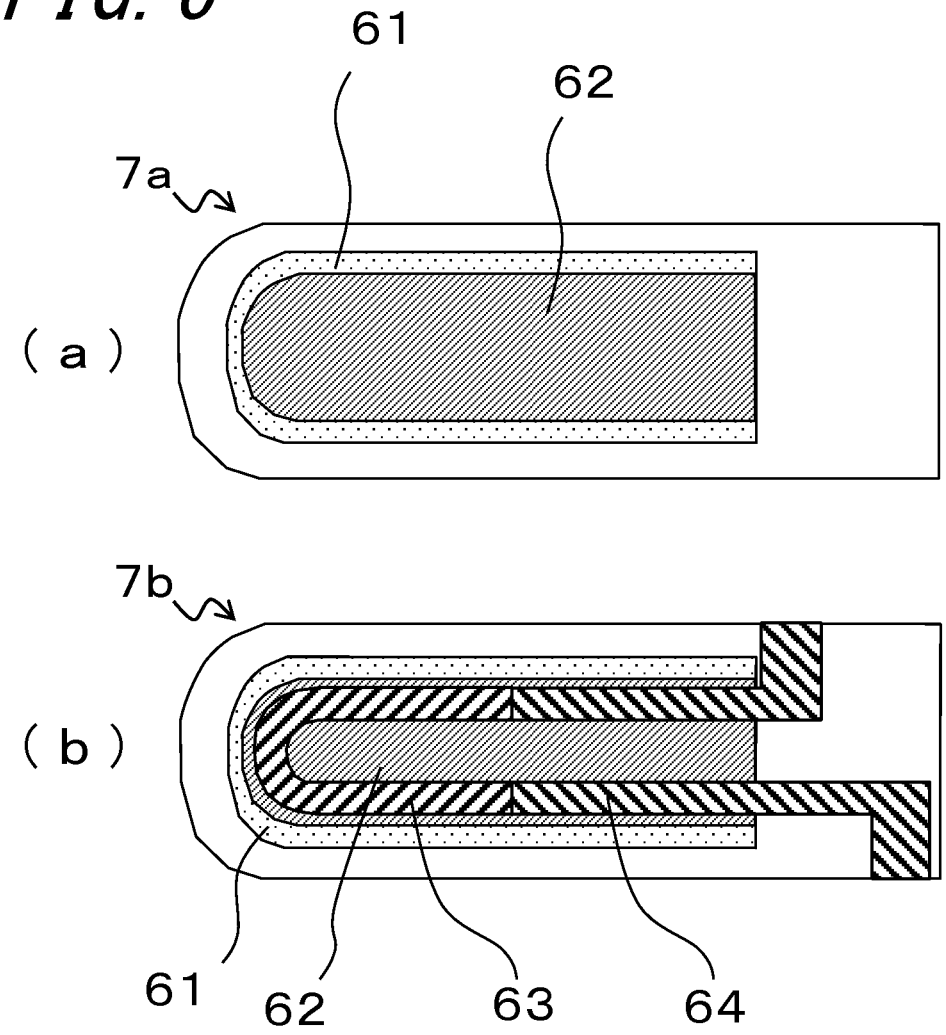
FIGS. 6(*a*) and 6(*b*) are explanatory views of a method for manufacturing a heater according to an embodiment of the present invention.

As illustrated in FIG. 6(*a*), a metal particle paste is applied to one main surface of the compact or the ceramic green sheet, for example, by screen printing to form a metal particle paste layer 61. The metal particle paste is a blend of metal particles having an average particle size in the range of 0.1 to 50 μm, a ceramic powder, a binder, and an organic solvent.

An insulating paste is then applied to the metal particle paste layer 61 so as to be slightly narrower than the metal particle paste layer 61 in the width direction to form an insulating paste layer 62. Thus, a compact 7*a* is obtained. The insulating paste is a blend of a ceramic powder, a binder, and an organic solvent.

The distribution of the metal particles 3 can be altered by changing the thickness of the metal particle paste layer 61 and the thickness of the insulating paste layer 62 or burying the insulating paste layer 62, an electrically conductive paste 63 for a heating element described below, and an electrically conductive paste 64 for a lead wire described below in the metal particle paste layer 61.

As illustrated in FIG. 6(*b*), the electrically conductive paste 63 for the heating element 2 and the electrically conductive paste 64 for the lead wires 4 are applied to the insulating paste layer 62 in the compact 7*a* to form a compact 7*b*. The materials of the electrically conductive paste 63 for a heating element and the electrically conductive paste 64 for a lead wire are mainly composed of a high-melting-point metal, such as W, Mo, or Re, that can be fired simultaneously with the compact serving as the insulating base body 1. The electrically conductive paste 63 for a heating element and the electrically conductive paste 64 for a lead wire can be prepared by mixing the high-melting-point metal with a ceramic powder, a binder, and an organic solvent.

Depending on the application of the heater, the lengths and widths of the patterns made of the electrically conductive paste 63 for a heating element and the electrically conductive paste 64 for a lead wire and the length and intervals of the folded pattern can be altered to achieve the desired heat-generating position or resistance of the heating element 2. Instead of the electrically conductive paste 64 for a lead wire, the lead wires 4 may be formed of a metal lead wire, for example, made of W, Mo, Re, Ta, or Nb.

The compact 7*a* and the compact 7*b* are joined to form a compact that includes the patterns made of the electrically conductive paste 63 for a heating element and the electrically conductive paste 64 for a lead wire surrounded by the metal particle paste layer 61 via the insulating paste layer 62.

The compact is then fired at a temperature in the range of 1500° C. to 1800° C. to manufacture a heater. The compact is preferably fired in an inert gas atmosphere or a reducing atmosphere. The compact is preferably fired under pressure.

Figure 7:
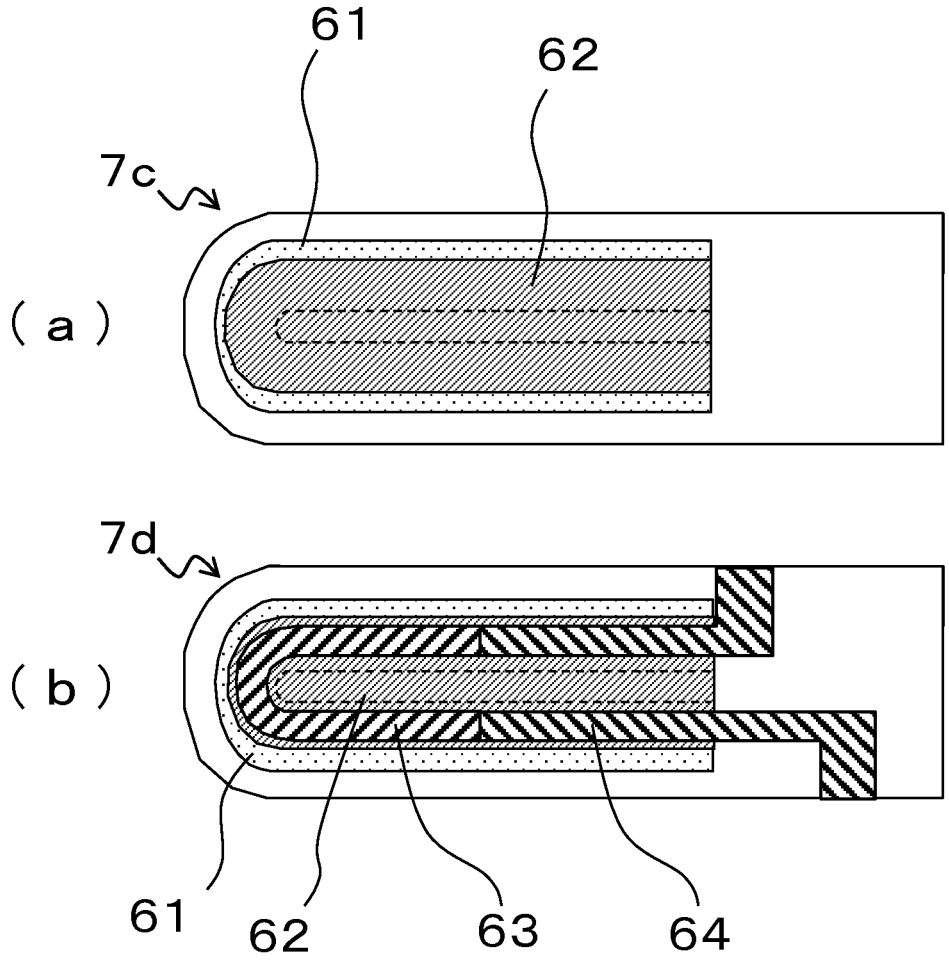
FIGS. 7(*a*) and 7(*b*) are explanatory views of a method for manufacturing a heater according to another embodiment of the present invention.
Figure 8:
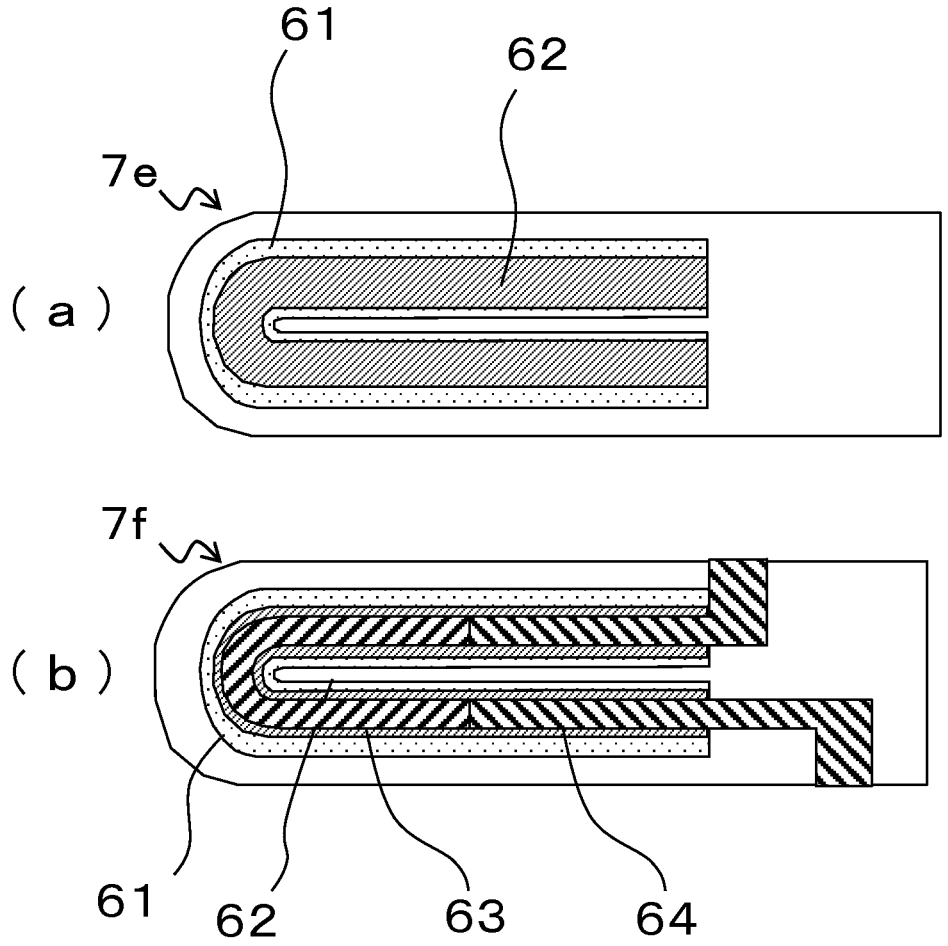
FIGS. 8(*a*) and 8(*b*) are explanatory views of a method for manufacturing a heater according to another embodiment of the present invention.

An embodiment as described in FIG. 2(*a*) can be formed by this method. Instead of this embodiment, as illustrated in FIG. 7(*a*), the metal particle paste layer 61 may be formed only in the vicinity of the patterns made of the electrically conductive paste 63 for a heating element and the electrically conductive paste 64 for a lead wire, and the insulating paste layer 62 is formed on the metal particle paste layer 61. As illustrated in FIG. 7(*b*), the electrically conductive paste 63 for a heating element and the electrically conductive paste 64 for a lead wire are then applied to the insulating paste layer 62 to provide an embodiment as illustrated in FIG. 2(*b*). As illustrated in FIG. 8(*a*), the metal particle paste layer 61 may be formed only in the vicinity of the patterns made of the electrically conductive paste 63 for a heating element and the electrically conductive paste 64 for a lead wire, and the insulating paste layer 62 having a narrower width than the metal particle paste layer 61 is formed on the metal particle paste layer 61. As illustrated in FIG. 8(*b*), the electrically conductive paste 63 for a heating element and the electrically conductive paste 64 for a lead wire are then applied to the insulating paste layer 62 to provide an embodiment as illustrated in FIG. 3.

Hot-press firing at high temperature and pressure produces high pressure in the lamination direction. This can make the cross-sectional shape of the metal particles 3 and the heating element 2 elliptical and make the major axis of the metal particles 3 parallel to the major axis of the heating element 2, in other words, allow the metal particles 3 and the heating element 2 to have an elliptical cross-section having the same major axis direction.

In order to bring the metal particles 3 into contact with each other, the metal powder constitutes 50% by mass or more of the metal particle paste.

EXAMPLES

A heater according to an example of the present invention was manufactured as described below.

First, a silicon nitride ($Si_3N_4$) powder constituting 85% by mass was mixed with a sintering aid containing an ytterbium ($Yb_2O_3$) powder, which constitutes 15% by mass, to prepare a ceramic powder.

The ceramic powder was shaped by press forming.

The ceramic powder was mixed with a W powder at a ratio described below. A metal particle paste containing 100 parts by mass of the mixture and 2 parts by mass of a binder was applied to one main surface of a compact by screen printing to form a metal particle paste layer.

A ceramic paste containing 100 parts by mass of the ceramic powder and 2 parts by mass of a binder was applied to the metal particle paste layer by screen printing to form an insulating paste layer. Thus, a compact was formed.

100 parts by mass of a mixture containing a WC powder constituting 70% by mass and a ceramic powder constituting 30% by mass was mixed with 2 parts by mass of a binder to prepare an electrically conductive paste for a heating element and an electrically conductive paste for a lead wire. The electrically conductive paste for a heating element and the electrically conductive paste for a lead wire were applied to the insulating paste layer by screen printing to form the compact 7*b*.

The compact 7*a* and the compact 7*b* were joined to form a compact that included a heating element, a lead wire, and metal particles in an insulating base body.

The compact was sintered by hot pressing in a cylindrical carbon mold in a reducing atmosphere at a temperature of 1700° C. at a pressure of 35 MPa to form a heater.

The sintered body was then ground into a cylinder having ϕ4 mm and a total length of 40 mm. A connector made of a Ni coil was brazed to a lead wire end (terminal) exposed on the surface of the cylinder to form a heater.

The W content of the metal particle paste layer and the thicknesses and shapes of the metal particle paste layer and the insulating paste layer were altered to prepare the following samples.

In a sample number 1, the W powder content of the metal particle paste was 5% by mass, and the remainder was a ceramic powder. A metal particle paste layer having a thickness of 300 μm was formed. An insulating paste layer having a thickness of 20 μm was formed 100 μm inside the periphery of the metal particle paste layer to form a compact 7*a* as illustrated in FIG. 6. An electrically conductive paste for a heating element and an electrically conductive paste for a lead wire were applied to the compact 7*a* 20 μm inside the periphery of the insulating paste layer to form a compact 7*b*.

As in the embodiment illustrated in FIGS. 1(*b*) and 1(*c*), a plurality of metal particles 3 were randomly distributed around the heating element 2 and the lead wires 4. The metal particles 3 were 10 μm or more separated from the heating element 2 and the lead wires 4.

In a sample number 2, the W powder content of the metal particle paste was 10% by mass, and the remainder was a ceramic powder. A metal particle paste layer having a thickness of 10 μm and having a central cavity was formed. An insulating paste layer having a thickness of 20 μm was formed 100 μm inside the periphery of the metal particle paste layer to form a compact 7*c* as illustrated in FIG. 7. An electrically conductive paste for a heating element and an electrically conductive paste for a lead wire were applied to the compact 7*c* 20 μm inside the periphery of the insulating paste layer to form a compact 7*d*. The central cavity of the metal particle paste layer was disposed 40 μm inside the gap between a portion of the electrically conductive paste for a heating element and a portion of the electrically conductive paste for a lead wire facing each other.

As in the embodiment illustrated in FIG. 2(*b*), a plurality of metal particles 3 surrounded the heating element 2 and the lead wires 4 (the metal particles 3 were arranged between the surface of the heating element 2 and the surface of the insulating base body 1 to surround the heating element 2). The metal particles 3 were 10 μm or more separated from the heating element 2 and the lead wires 4.

In a sample number 3, the W powder content of the metal particle paste was 10% by mass, and the remainder was a ceramic powder. A metal particle paste layer having a thickness of 10 μm and having a central cavity was formed. An insulating paste layer having a thickness of 20 μm and having a central cavity was formed 100 μm inside the periphery of the metal particle paste layer to form a compact 7*e* as illustrated in FIG. 8. The central cavity of the metal particle paste layer was disposed 200 μm inside the central cavity of the insulating paste layer. An electrically conductive paste for a heating element and an electrically conductive paste for a lead wire were applied to the compact 7*e* 20 μm inside the periphery of the insulating paste layer to form a compact 7*f*. The central cavity of the insulating paste layer was disposed 40 μm inside the gap between a portion of the electrically conductive paste for a heating element and a portion of the electrically conductive paste for a lead wire facing each other.

As in the embodiment illustrated in FIG. 3, a plurality of metal particles 3 surrounded the heating element 2 and the lead wires 4 (the heating element 2 had a folded shape, and the metal particles 3 were arranged along the heating element 2 to surround the heating element 2). The metal particles 3 were 10 μm or more separated from the heating element 2 and the lead wires 4.

In a sample number 4, the W powder content of the metal particle paste was 50% by mass, and the remainder was a ceramic powder. A metal particle paste layer having a thickness of 10 μm and having a central cavity was formed. An insulating paste layer having a thickness of 20 μm and having a central cavity was formed 100 μm inside the periphery of the metal particle paste layer to form a compact 7*e* as illustrated in FIG. 8. The central cavity of the metal particle paste layer was disposed 200 μm inside the central cavity of the insulating paste layer. An electrically conductive paste for a heating element and an electrically conductive paste for a lead wire were applied to the compact 7*e* 20 μm inside the periphery of the insulating paste layer to form a compact 7*f*. The central cavity of the insulating paste layer was disposed 40 μm inside the gap between a portion of the electrically conductive paste for a heating element and a portion of the electrically conductive paste for a lead wire facing each other.

As in the embodiment illustrated in FIG. 5(*b*), a plurality of metal particles 3 surrounded the heating element 2 and the lead wires 4 and were 10 μm or more separated from the heating element 2 and the lead wires 4. Because of the high W content of the metal particle paste, at least one portion of each of the metal particles 3 was in contact with another metal particle 3.

In a sample number 5, the W powder content of the metal particle paste was 5% by mass, and the remainder was a ceramic powder. A metal particle paste layer having a thickness of 300 μm was formed only on the heating element portion. An insulating paste layer having a thickness of 20 μm was formed on the metal particle paste layer 100 μm inside the periphery of the metal particle paste layer. An electrically conductive paste for a heating element was applied to the insulating paste layer 20 μm inside the periphery of the insulating paste layer.

A plurality of metal particles 3 were randomly distributed only around the heating element 2 and were 10 μm or more separated from the heating element 2.

In a sample number 6, the W powder content of the metal particle paste was 10% by mass, and the remainder was a ceramic powder. A metal particle paste layer having a thickness of 20 μm and having a central cavity was formed. An insulating paste layer having a thickness of 20 μm and having a central cavity was formed 100 μm inside the periphery of the metal particle paste layer to form a compact 7*e* as illustrated in FIG. 8. The central cavity of the metal particle paste layer was disposed 200 μm inside the central cavity of the insulating paste layer. An electrically conductive paste for a heating element and an electrically conductive paste for a lead wire were applied to the compact 7*e* 20 μm inside the periphery of the insulating paste layer to form a compact 7*f*. The central cavity of the insulating paste layer was disposed 40 μm inside the gap between a portion of the electrically conductive paste for a heating element and a portion of the electrically conductive paste for a lead wire facing each other. The hot pressing was performed at high temperature and pressure of 1780° C. and 50 MPa.

Thus, the metal particles 3, the heating element 2, and the lead wires 4 had an elliptical cross section. The metal particles 3 were 10 μm or more separated from the heating element 2 and the lead wires 4. The metal particles 3 surrounding the heating element 2 and the lead wires 4 had the same major axis direction as the heating element 2 and the lead wires 4.

A sample number 7 was a heater for the comparison purpose, which contained no metal particles 3 around the heating element 2.

Rectangular pulses were sent to each heater at an applied voltage of 100 V, a pulse width of 10 μs, and pulse intervals of 1 μs. More specifically, a loop antenna was connected to an oscilloscope, signals amplified with an amplifier were read, and noises were compared. The loop antenna had a wire diameter of ϕ1 and a loop diameter of ϕ10. Signals were read while the loop antenna was 5 cm separated from the heating element 2 and the lead wires 4 of the heater. Table 1 shows the results.

TABLE 1

| Sample No. | Structure | Location | Evaluation of noise: Near heating element | Evaluation of noise: Near lead wires |
|---|---|---|---|---|
| 1 | FIG. 1 | Heating element and lead wires | 100 mV | 50 mV |
| 2 | FIG. 2(b) | Heating element and lead wires | 45 mV | 23 mV |
| 3 | FIG. 3 | Heating element and lead wires | 5 mV | 3 mV |
| 4 | FIG. 5(b) | Heating element and lead wires | 0.1 mV | 0.04 mV |
| 5 | FIG. 1 | Heating element alone | 90 mV | 380 mV |
| 6 | FIG. 5(b) | Heating element and lead wires | 6 mV | 3.5 mV |
| 7 | No metal particle | — | 800 mV | 420 mV |

The results in Table 1 show that the heater of the sample number 7, which contained no metal particles 3 around the heating element 2, had a noise voltage of more than 500 mV, which is highly likely to adversely affect a control circuit. In contrast, the heaters of the sample numbers 1 to 6 according to the present examples had a noise voltage as low as 100 mV or less.

The heater of the sample number 3 according to the present example and the heater of the sample number 7 according to the comparative example were subjected to an overvoltage test to examine the development of a crack upon the application of an excessive voltage. More specifically, a voltage of 250 V was applied to each sample. When the temperature reached 1500° C., the voltage application was stopped. This operation was performed five times. An insulating base body surface of the heater near the heating element was observed with a stereoscopic microscope at a magnification of 40 to check for cracks.

Although the heater of the sample number 7 had a crack on its surface, the heater of the sample number 3 had no crack on its surface.

Cross sections of the heater of the sample number 3 and the heater of the sample number 7 were observed with a scanning electron microscope (SEM) (JSM-6700 manufactured by JEOL Ltd.) at a magnification of 100. In the heater of the sample number 3, the development of cracks around the heating element was stopped at the metal particle portion, and cracks did not reach the heater surface. In contrast, in the sample number 7, cracks around the heating element 2 reached the heater surface.

The heaters of the sample numbers 3 and 6 according to the present example and the heater of the sample number 7 according to the comparative example were subjected to a rapid water cooling test to examine the breakage of the heaters upon rapid cooling. More specifically, the 5-mm tip of each of the samples heated to 1200° C. by voltage application was immersed in water at 25° C. for one second. The resistance of each heater before and after the test was measured with a digital multimeter (resistance meter 3541 manufactured by Hioki E.E. Corp.) to check for breakage. The heater surface was observed with a stereoscopic microscope at a magnification of 40 to check for cracks.

As a result, although the heaters of the sample numbers 3 and 6 had cracks on their surfaces, the resistance before and after the test was the same, indicating no breakage. In contrast, the heater of the sample number 7 had cracks on its surface and had infinite resistance, which indicated breakage, after the test.

Cross sections of the heaters of the sample numbers 3 and 6 and the heater of the sample number 7 were observed with a scanning electron microscope (SEM) (JSM-6700 manufactured by JEOL Ltd.) at a magnification of 100. In the heaters of the sample numbers 3 and 6, the development of cracks on the surface was stopped at the metal particle portion, and cracks did not reach the heating element. More specifically, an end of a crack in the heater of the sample number 3 did not run along metal particles but run through the insulating base body. A crack up to its end in the heater of the sample number 6 run along distributed metal particles. In contrast, a crack on the surface of the heater of the sample number 7 reached the heating element, and the heating element was broken.

REFERENCE SIGNS LIST

1 insulating base body
2 heating element
3 metal particle
4 lead wire
5 connector
61 metal particle paste layer
62 insulating paste layer
63 electrically conductive paste for heating element
64 electrically conductive paste for lead wire
7*a*, 7*b*, 7*c*, 7*d*, 7*e*, 7*f* compact

The invention claimed is:

1. A heater, comprising:

a heating element;

a pair of lead wires each connected to an end of the heating element; and an insulating base body in which the heating element and the pair of lead wires are embedded, wherein the insulating base body contains a plurality of metal particles that surround the heating element and are separated from the heating element, wherein the plurality of metal particles is configured to reduce noise generated by pulse driving of the heater, and wherein the plurality of metal particles and the heating element comprise an elliptical cross-section with a same major axis direction.

2. The heater according to claim 1, wherein the plurality of metal particles are disposed between a surface of the heating element and a surface of the insulating base body.

3. The heater according to claim 2, wherein the plurality of metal particles are arranged to partition the insulating base body between the surface of the heating element and the surface of the insulating base body.

4. The heater according to claim 1, wherein the heating element comprises a folded shape, and the plurality of metal particles are arranged along the heating element.

5. The heater according to claim 1, wherein the plurality of metal particles are in contact with each other.

6. The heater according to claim 1, further comprising a second plurality of metal particles around the pair of lead wires, wherein the second plurality of metal particles are separated from the pair of lead wires.

7. The heater according to claim 1, wherein each of the plurality of metal particles are arranged at regular intervals around the heating element.

8. The heater according to claim 7, wherein the regular intervals are 5 μm or less.

9. The heater according to claim 7, wherein the regular intervals are in a range of 100 to 500 μm.

* * * * *